US006321424B1

(12) United States Patent
Sheldon

(10) Patent No.: US 6,321,424 B1
(45) Date of Patent: Nov. 27, 2001

(54) METHOD AND APPARATUS FOR FEEDING TUBULAR TEXTILES INTO A MACHINE

(75) Inventor: Philip R. Sheldon, Woodstock (CA)

(73) Assignee: Valleycroft Textiles Inc., Cambridge (CA)

( * ) Notice: Subject to any disclaimer, the term of this patent is extended or adjusted under 35 U.S.C. 154(b) by 0 days.

(21) Appl. No.: 09/562,853

(22) Filed: May 1, 2000

(30) Foreign Application Priority Data

Apr. 28, 2000 (CA) ..... 2307088

(51) Int. Cl.[7] ..... D06C 5/00
(52) U.S. Cl. ..... 26/80; 26/83
(58) Field of Search ..... 26/80, 82, 83, 26/84, 85, 71, 51; 66/149 R, 150, 151, 152, 153; 38/70, 102.1, 102.3, 102.4; 242/615, 615.4

(56) References Cited

U.S. PATENT DOCUMENTS 1,381,632 * 6/1921 Haas et al. ..... 26/83
2,668,324 * 2/1954 Johnson ..... 26/80
3,098,279 * 7/1963 Brunner ..... 26/83
3,317,951 * 5/1967 Hureau ..... 26/80
3,784,662 * 1/1974 Hino et al. ..... 26/83
4,288,999 * 9/1981 Sterling et al. ..... 26/80
4,314,462 2/1982 Ducol et al. ..... 66/152
4,885,826 * 12/1989 Strudel ..... 26/80
5,233,734 * 8/1993 Strudel et al. ..... 26/80
5,701,641 12/1997 Catallo ..... 26/80

* cited by examiner

*Primary Examiner*—Amy B. Vanatta
(74) *Attorney, Agent, or Firm*—Dimock Stratton Clarizio; Mark B. Eisen

(57) ABSTRACT

A method and apparatus for guiding a textile tube to the rollers of a machine, which reduces the tensioning of the fabric and accordingly reduces post-production shrinkage. A feeding arm mounted on a support, preferably at a slight downward incline, provides a spreader having a breadth sufficient to flatten the textile tube. In a preferred embodiment a plurality of feeding arms are rotatably mounted to the support, so that as one feeding arm is being used to feed the fabric into the machine another feeding arm can be loaded with a textile tube.

20 Claims, 2 Drawing Sheets

METHOD AND APPARATUS FOR FEEDING TUBULAR TEXTILES INTO A MACHINE

FIELD OF THE INVENTION

This invention relates to textile handling. In particular, this invention relates to a method and apparatus for feeding tubular textiles into a set of rollers in a machine, in a manner that avoids tensioning of the fabric and thus minimizes shrinkage of the fabric in finished textile goods.

BACKGROUND OF THE INVENTION

A well-known problem in textile manufacture is the tendency of textiles to be distorted and stretched during manufacture and handling. If this distortion is not removed prior to manufacture of the finished garment, the garment will shrink when laundered as the tension in the fabric is relaxed. This is most apparent in garments manufactured from knit textiles, which are more prone to stretching and distortion than woven textiles.

When machine-knitted fabric comes off of the needle bed of the knitting machine, it is typically dyed in a dye kettle, wetted out on a pad for impregnating the fabric with desired additives (for example fabric softener), dried, and then fed into a processing machine such as a compacter or calender for surface finishing, and finally machine-rolled. The knitting, dyeing, wetting out, drying and rolling processes place the fabric under tension, resulting in a distortion of the fabric gauge from its relaxed state. The fabric remains distorted through subsequent cutting and making up stages, with the result that the finished garment retains this distortion. When the garment is washed and dried, the fabric relaxes and returns to its relaxed gauge, resulting in a garment that is smaller and more dense than when it was purchased. Thus, a garment manufacturer or distributor may estimate the amount of shrinkage that is likely to occur and specify an oversized garment to compensate for anticipated shrinkage.

It is therefore desirable to alleviate the effect of shrinkage during the textile manufacture or garment manufacture stages, before exposing the finished garment for sale. One method is to cut oversized garment pieces from the distorted fabric, with an excess length and width allowance so that when the garment is washed after processing, the garment will shrink down to its intended size. However, not all textiles stretch or shrink to the same degree, and even within the same roll of fabric the distortion and subsequent relaxation may not be consistent.

Shrinkage can be alleviated during the production stage by pre-shrinking the fabric. One method of accomplishing this is by wetting and tumble-drying the fabric. However, this process must be performed on the unrolled textile. Once the pre-shrinking process is completed, the fabric must be returned to roll form. Machine-rolling the pre-shrunk fabric again places it under tension, thus substantially eliminating any beneficial effect of pre-shrinking.

These difficulties are more pronounced when handling textiles manufactured in tubular form, which includes both textiles knitted in the round and textiles knitted flat and then joined along a selvedge to form a tube. In order to roll tubular textiles, the tube must be flattened. The fabric may then be belt-dried, however the fabric must be drawn into the belt dryer, which at best does not relax the fabric and may actually tension the fabric even more and exacerbate the extent of shrinkage. The alternative of tumble-drying the fabric does relax the fabric, however any relaxation of the fabric after tumble-drying is largely lost when the fabric is machine-rolled for further processing.

Another solution is to pre-wash the finished goods before sale to a distributor or retailer. This solution virtually eliminates shrinkage, however the pre-washed garments end up with a distressed look, which the distributor may not want, and it can nevertheless be difficult to provide a consistent degree of shrinkage in garments fabricated from different fabric batches or rolls.

U.S. Pat. No. 4,363,161 issued Dec. 14, 1982 to Catallo teaches a compacter for compressing a fabric, which reduces the amount of shrinkage in the textile roll and thus in the finished garments. However, this apparatus is fairly complex, and while it reduces shrinkage it cannot eliminate shrinkage, so the same problems are manifest, although to a lesser degree, in product manufactured from fabric treated through this compacter.

It would accordingly be advantageous to provide a method and apparatus for rolling a tubular textile without stretching the fabric, so that shrinkage removed prior to manufacture of the textile into finished garments is not reintroduced when the fabric is rolled into a form suitable for further processing.

SUMMARY OF THE INVENTION

The present invention provides an apparatus and method for guiding tubular textile goods to the rollers of a machine, for example a fabric roll-up machine, in a manner which avoids tensioning the fabric, and accordingly reduces or substantially eliminates post-production shrinkage in the textile roll and thereafter in finished garments fabricated therefrom.

The invention accomplishes this by providing a feeding arm mounted on a support, preferably at a slight downward incline. The feeding arm provides a spreader facing the machine and having a breadth sufficient to flatten the textile tube, preferably such that the textile tube is placed under slight lateral tension when pulled over the spreader. In a preferred embodiment a plurality of feeding arms are rotatably mounted to the support, so that as one feeding arm is being used to feed the fabric into the roll-up machine another feeding arm can be loaded with a new length of tubular textile for rolling.

The present invention thus provides an apparatus for guiding a textile tube to a machine having a set of rollers defining a fabric intake passage, the apparatus comprising: a support, a feeding arm having a first end mounted to the support and a second end, and a spreader mounted to the feeding arm for spreading the textile tube in a direction of the intake passage, wherein when the feeding arm is oriented in a feeding position extending substantially perpendicular to the intake passage and the textile tube is fed into the intake passage, the rollers draw the textile tube off of the feeding arm with substantially no longitudinal tension on the textile tube.

The present invention further provides an apparatus for rolling a textile tube, comprising a set of rollers defining a fabric intake passage, a support spaced from the fabric intake passage, a feeding arm having a first end mounted to the support and a second end, and a spreader mounted to the feeding arm for spreading the textile tube in a direction of the intake passage, wherein when the feeding arm is oriented in a feeding position extending substantially perpendicular to the intake passage and the textile tube is fed into the intake passage, the rollers draw the textile tube off of the feeding arm with substantially no longitudinal tension on the textile tube.

In further aspects of the apparatus the feeding arm is rotatably mounted to the support and can be rotationally fixed in the feeding position; the feeding arm is supported at an angle of declination such that the second end is supported at a height lower than a height of the first end; the angle of declination of the feeding arm is adjustable, optionally by an adjusting bolt axially fixed relative to the support bears against the feeding arm; a plurality of feeding arms are rotatably mounted to the support; the spreader is removable and/or laterally tensions the textile tube; and the spreader comprises shoulders which diverge in a direction of removal of the textile tube.

The present invention further provides a method of feeding a textile tube into a set of rollers defining a fabric intake passage, comprising the steps of: a. loading a textile tube onto a feeding arm, b. positioning the feeding arm in alignment with the intake passage and substantially perpendicular to the intake passage drawing the textile tube off of the feeding arm, c. drawing a free end of the textile tube to the intake passage such that the rollers draw the textile tube off of the feeding arm, and d. spreading the textile tube to flatten same as the textile tube is drawn off of the feeding arm by the rollers. In a further aspect of the method a lateral tension is applied to the textile tube during spreading.

BRIEF DESCRIPTION OF THE DRAWINGS

In drawings which illustrate by way of example only a preferred embodiment of the invention.

DETAILED DESCRIPTION OF THE INVENTION

Figure 1:
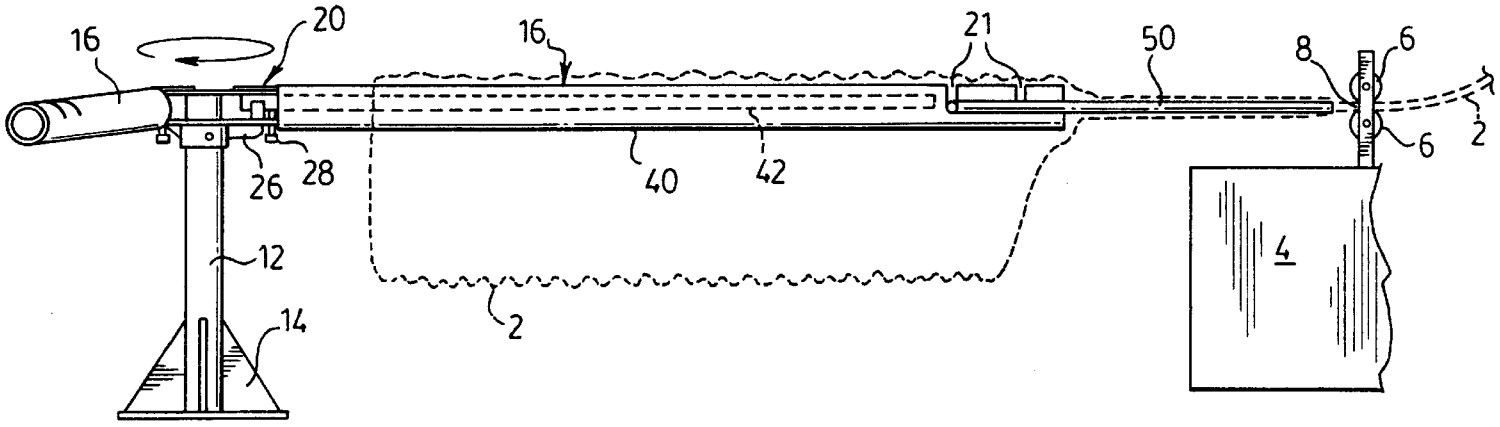
FIG. 1 is a side elevation of a preferred embodiment of the apparatus of the invention.
Figure 2:
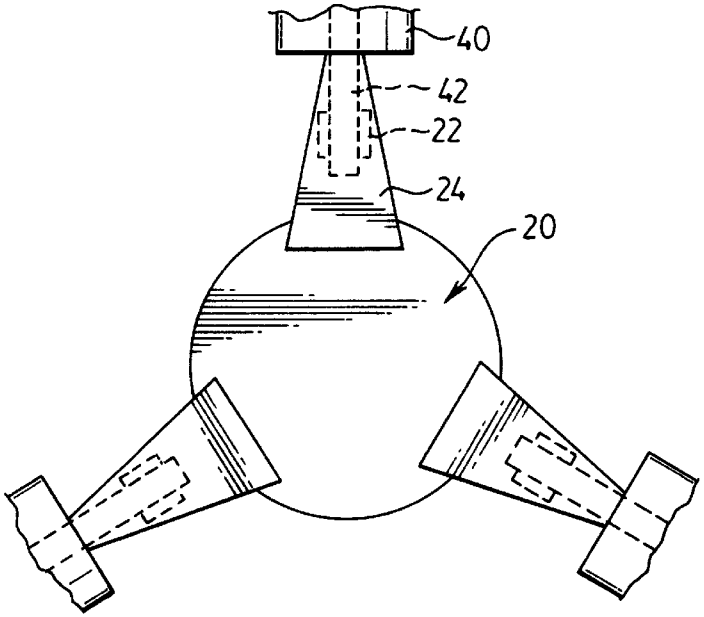
FIG. 2 is a partial top plan view of the apparatus of FIG. 1.
Figure 3:
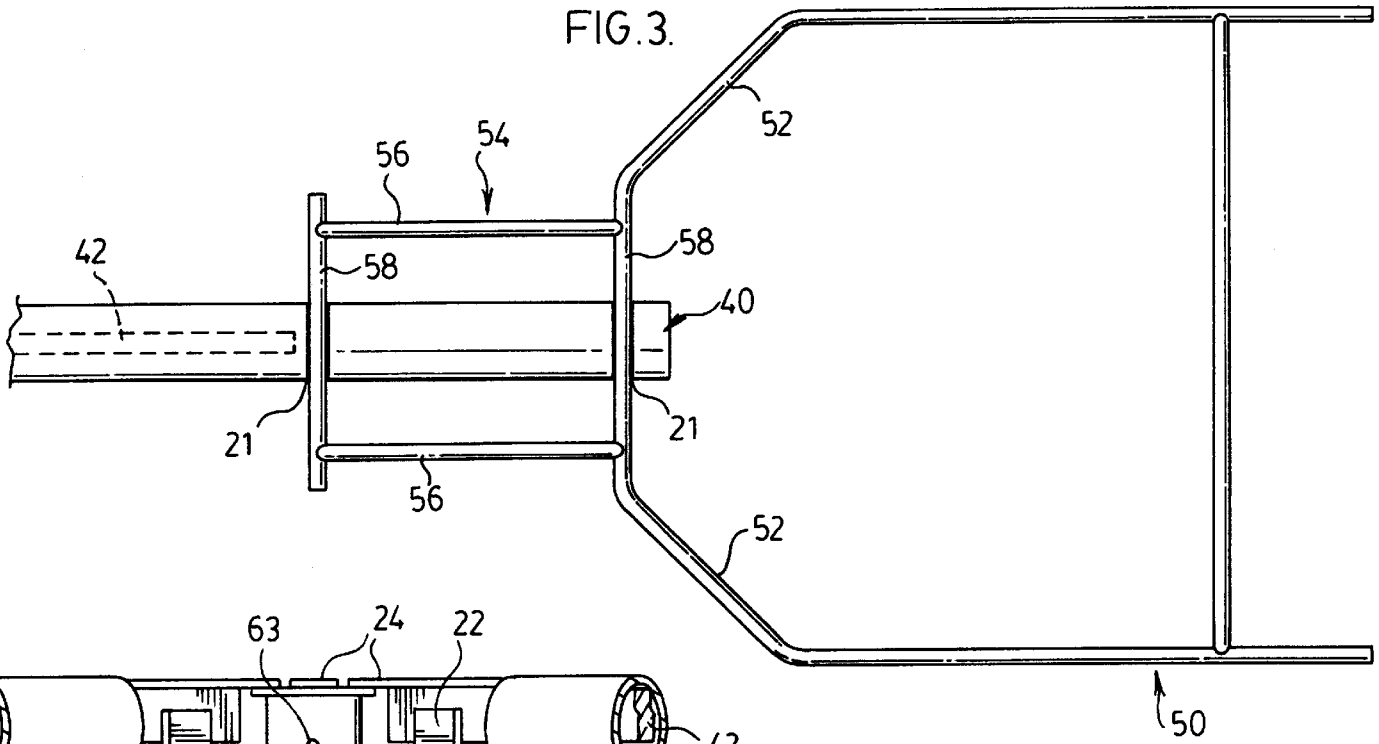
FIG. 3 is a plan view of the spreader in the apparatus of FIG. 1.
Figure 4:
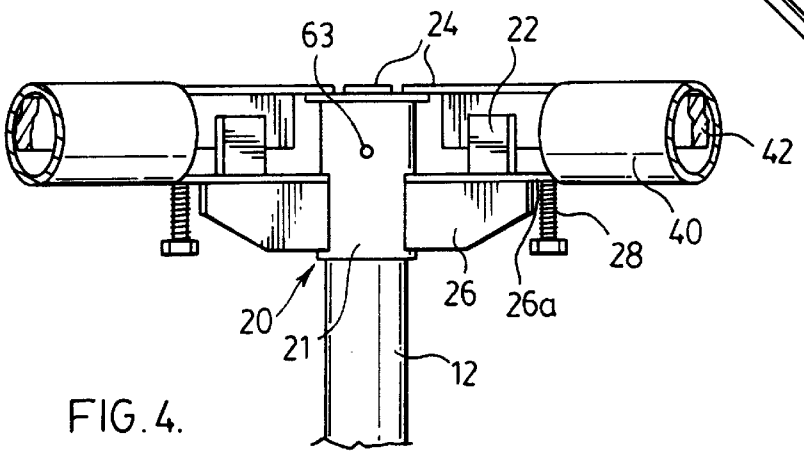
FIG. 4 is an enlarged partial side elevation of the apparatus of FIG. 1.

FIG. 1 illustrates an apparatus 10 for feeding a textile tube 2 into a machine 4, which may for example be a textile roll-up machine or any other type of fabric processing apparatus. The machine 4, illustrated in FIG. 1, comprises a set of parallel rollers 6 defining a fabric intake passage 8 therebetween through which fabric may be fed, and may be constructed by stripping down a conventional calendering machine so that only a single set of rollers 6 remains. Although the invention will be described in relation to the machine 4 shown, but can be utilized in conjunction with any type of machine which provides a fabric intake passage 8 between a set of parallel rollers 6, and the invention is not intended to be limited to the particular use or environment illustrated.

The apparatus 10 includes a support comprising a pedestal 12 having a base 14 which may be fastened to the floor of the work area in front of the machine 4, to prevent tipping of the apparatus 10 when loaded with a textile tube 2, shown in phantom in FIG. 1. The pedestal 12 may alternatively be attached to the machine 4 by means of a bracket or base plate (not shown) extending from the pedestal 12 to the machine 4, or may be constructed integrally with the machine 4. The pedestal 12 and base 14 are preferably constructed of a rigid, sturdy material such as cast iron.

A crown 20 is mounted to the upper end of the pedestal 12. The crown 20 is preferably a separate component rotatably mounted on the pedestal 12, for reasons which are described below. The crown 20 may alternatively be formed integrally with the pedestal 12, in which case the pedestal 12 is preferably rotatable within the base 14.

In the embodiment illustrated the crown 20 comprises a brace 26 extending substantially radially from the crown 20 to support the feeding arm 16. The brace 26 has an extension 26*a* and an adjusting bolt 28 is threadedly engaged through the extension 26*a* of the brace 26 so as to project upwardly and contact the feeding arm 16. The bolt 28 thus supports the feeding arm 16 and can be adjusted to alter the inclination of the feeding arm 16, as described below.

The feeding arm 16 preferably comprises a smooth outer sleeve 40 and an inner reinforcing bar 42, shown in phantom in FIG. 1, which renders the feeding arm 16 substantially rigid. In the preferred embodiment the outer sleeve 40 comprises a tube having a cylindrical or otherwise generally curvate shape with a smoothly contoured outer surface. The outer sleeve 40 may be composed of a section of plastic tubing, for example ABS pipe, which provides a sufficiently smooth exterior contour and surface to allow the textile tube 2 to slip off of the sleeve 40 as it is fed into the machine 4.

The length of outer sleeve 40 is determined by the distance of the pedestal 12 from the machine 4 and by the length of the textile tube 2 to be fed from the feeding arm 16. The length of the feeding arm 16 should be sufficient to hold the entire length of a textile tube 2 when gathered as shown in FIG. 1; for example, an 8 foot length has been found to be adequate for most standard textile tubes 2.

The reinforcing bar 42 may be composed of any sufficiently strong and rigid material, for example rectangular steel tubing. The reinforcing bar 42 is mounted to the crown 20, preferably spaced from the brace 26 to allow room for adjusting the inclination of the feeding arm 16 as described below, by a gusset 24 welded or otherwise suitably affixed to the proximal end of the reinforcing bar 42 and to the crown 20. The outer sleeve 40 is inserted over the inner reinforcing bar 42, and may be axially fixed thereto by any suitable means.

The distal end 19 of the feeding arm 16 supports a spreader 50 which flattens the textile tube 2 as the tube 2 is fed into the fabric intake passage 8. In the preferred embodiment shown the spreader 50 is configured with a generally rectangular, planar shape, the breadth of the spreader 50 being slightly greater than the width of the flattened textile tube 2. The textile tube 2 is therefore slightly stretched laterally as it passes over the spreader 50. The spreader 50 preferably comprises gently sloping shoulders 52 which diverge in the direction of removal of the textile tube 2, to reduce longitudinal drag on the textile tube 2 as it is fed into the machine 4. In the embodiment shown, the shoulders 52 are angled at approximately 45 degrees and present rounded comers, however the angle and degree of curvature of the shoulders 52 may vary as long as the spreader 50 provides relatively little longitudinal resistance to the textile tube 2 in the direction of removal of the textile tube 2.

An angle of declination of the feeding arm 16 is established when installing the apparatus 10 in front of a machine 4, by turning the adjusting bolt 28 as described below or by otherwise propping the reinforcing bar 42 up on the brace 26 using a wedge, block or spacer (not shown). This brings the spreader 50 into vertical alignment with the fabric intake passage 8 to facilitate a smooth transfer of the textile tube 2 through the rollers 6. Once the optimal angle of declination is determined, optionally the feeding arm 16 may be fixed in position, for example by a bracket 22 which may comprise a steel plate welded or otherwise suitably affixed to the reinforcing bar 42 and the brace 26. Thereafter the bracket 22 must be removed in order to alter the angle of declination of the feeding arm 16, for example to install the apparatus 10 for use with a different machine 4.

In the preferred embodiment the spreader 50 is removable. Thus, in the embodiment illustrated the shoulders 52 are connected to a yoke 54 comprising parallel bars 58 fixed in spaced relation by a pair of braces 56. The outer sleeve 40 of the feeding arm 16 projects beyond the reinforcing bar 42 at its distal end 19, as shown in FIG. 1, and the projecting portion of the sleeve 40 is provided with a pair of slots 21 spaced apart to match the distance between parallel bars 58. The spreader 50 is thus axially fixed to the textile arm 16 by inserting the parallel bars 58 into the slots 21 as shown. The outer sleeve 40 thus projects beyond the reinforcing bar 42 so that the reinforcing bar 42 does not interfere with the proper seating of the yoke.

Other means of attachment may be used to fix the spreader 50 to the feeding arm 16, but preferably the spreader 50 can be removed for loading a textile tube 2 on to the textile arm 16 and allowing the apparatus to accommodate textile tubes 2 of varying sizes. The spreader 50 may alternatively be adjustable, to increase or decrease its breadth to accommodate textile tubes 2 of varying sizes, or attachments may be provided (not shown) which increase the breadth of the spreader 50.

In other embodiments the feeding arm 16 may be composed of any integral member which is sufficiently strong and rigid to support the textile tube 2, having a generally smooth outer surface to minimize resistance. The spreader 50 may alternatively be formed as a solid piece, such as a paddle, as opposed to a frame as shown, with the object of minimizing resistance to the textile tube 2 to avoid longitudinal stretching as the tube 2 is fed into the machine 4.

The feeding arm 16 is preferably mounted to the crown 20 such that the feeding arm 16 extends generally radially at a slightly downward angle of declination relative to the horizontal. The distal end 19 of feeding arm 16 is therefore suspended at a slightly lower height than the proximal end 18. The degree of the angle of declination is such as to permit the textile tube 2 to slide along the outer sleeve 40 with relative ease, i.e. the angle of declination allows gravity to compensate for the slight frictional resistance provided by the feeding arm 16.

In the preferred embodiment illustrated the crown 20 is rotatably mounted on the pedestal 12 so that the distal end 19 of the textile arm 16 can be swung away from the machine 4 to facilitate loading textiles 2. In this embodiment the apparatus 10 may be provided with a plurality of feeding arms 16, three in the embodiment shown. The crown 20 is provided with releasable locking means, for example comprising a locking pin (not shown) which is removably inserted through an opening 63 through the hub 21 of the crown 20 and through one of a series of openings (not shown) in the upper end of the pedestal 12, to rotationally lock the crown 20 to the pedestal 12 with the loaded feeding arm 16 in a feeding position in front of the machine 4. Alternatively, a plurality of openings 63 in the hub 21 may be provided to align with one or more openings (not shown) in the pedestal 12 as each feeding arm 16 is rotated into the feeding position in front of the machine 4, or any other suitable rotational locking mechanism may be used.

In the embodiment illustrated, the three feeding arms 16 are mounted on the crown 20 in generally equally spaced relation. Although any practical number of feeding arms 16 may be mounted to the crown 20, three feeding arms 16 have been found to be sufficient, and for proper balance it is preferable to have the plurality of feeding arms 16 spaced evenly around crown 20.

It will be apparent that, since the spreader 50 is removable and is only required on the particular feeding arm 16 that is in the feeding position, a single spreader 50 is sufficient to operate the multiple-arm embodiment illustrated.

To install the apparatus of the invention, the apparatus 10 is positioned in front of the machine 4 such that when a feeding arm 16 is in the feeding position it is laterally aligned with and substantially perpendicular to the fabric intake passage 8 defined between the rollers 6 of the machine 4. There should be a sufficient distance between the spreader 50 and the rollers 6 that the fabric has an opportunity to relax from the lateral tension on the textile tube 2 caused by the spreader 50, but the distance between the spreader 50 and the rollers 6 should be sufficiently small to avoid any substantial sagging of the textile tube 2 before it enters the intake passage 8.

To adjust the angle of declination to bring the spreader 50 into substantially vertical alignment with the fabric intake passage 8, the adjusting bolt 28 may be rotated to protrude further into the brace 26, to decrease the angle of declination, or rotated to recede out of the brace 26, to increase the angle of declination. Once the optimal angle of declination has been determined for the particular machine 4, the angle of declination can be fixed by affixing bracket 22 between the brace 26 and the reinforcing bar 42.

In use, a textile tube 2 is removed from a previous processing stage, for example tumble-drying. The textile tube 2 may have been gathered and tied into a loose toroid or "doughnut" shape prior to washing and tumble-drying, to avoid tangling of the textile tube 2 during the washing and drying processes. This eliminates extra labour in untangling the textile tube 2 after each of the washing and tumble-drying processes, and avoids tensioning the fabric while it is being untangled. However, the method of the invention can also be employed to roll an ungathered textile tube 2, by untangling the textile tube 2 for loading onto the apparatus 10 of the invention.

The spreader 50 is removed from a feeding arm 16 if necessary, and the textile tube 2 is loaded onto the feeding arm 16, preferably so as to minimize twisting of the tubular form. The textile tube 2 is unfurled from the toroidal or "doughnut" condition if necessary, or untangled and gathered as necessary, and inserted over the feeding arm 16 so that the feeding arm 16 extends fully through the textile tube 2. The feeding arm 16 is rotated into the feeding position by rotating the crown 20 so that the loaded feeding arm 16 is aligned with and extends substantially perpendicular to the fabric intake passage 8. The crown 20 is locked in position by inserting the locking pin (not shown) into an opening in the pedestal 12 (not shown) aligned with the opening 63 through the hub 21, and the spreader 50 is engaged to the feeding arm 16 as described above.

The textile tube 2 is manually drawn over the spreader 50 so that the grain of the fabric is substantially parallel to the direction of the textile arm 16, held laterally taut by the spreader 50. The spreader 50 thus supports the textile tube 2 in a relatively flat configuration for passage through the fabric intake passage 8. The textile tube 2 is then manually drawn toward the machine 4 and the free end of the textile tube 2 is fed into the fabric intake passage 8.

The feeding arm 16 guides the textile tube 2 into the fabric intake passage 8. The slight angle of declination and the smooth surface of the outer sleeve 40 allow the textile tube 2 to "fall" off of the feeding arm 16, under the influence of gravity, as the rollers 6 draw the textile tube 2 through the intake passage 8. The process of taking up and rolling the textile tube 2 using a machine 4 or the like is conventional and well known to those skilled in the art.

Thus, the only distorting tension exerted on the textile tube 2 prior to feeding into the fabric intake passage 8 is the lateral tension applied by the spreader 50 to flatten the textile roll 2. Due to the clearance between the spreader 50 and the rollers 6, this lateral tension is released as the textile tube 2 is drawn off of the spreader 50 and before it is fed into the intake 8. The apparatus 10 of the invention thus results in a substantial reduction in longitudinal tension exerted on the textile tube 2 during the rolling (or any other feeding) process, particularly if a single set of rollers is used in the machine 4. Thus, distortion of the fabric is minimized and post-production shrinkage of the rolled fabric and thereafter of the finished garments fabricated therefrom, is significantly reduced or substantially eliminated.

While the loaded textile tube 2 is being fed into the machine 4, the unused feeding arms 16 may be loaded with other textile tubes 2 in a similar manner. When the feeding textile tube 2 has been completely drawn off of the feeding arm 16, the spreader 50 is disengaged. The locking pin (not shown) is removed to release the crown 20, and the crown 20 is rotated manually so that the newly loaded feeding arm 16 is brought to the feeding position. The locking pin is replaced in the newly aligned openings 63, 65 to lock the crown 20 in position, the spreader 50 is engaged to the newly loaded feeding arm 16, and the process of feeding the textile tube 2 into the machine 4 is repeated.

Preferred embodiments of the invention having been thus described by way of example, modifications and adaptations will be apparent to those skilled in the art. The invention includes all such modifications and adaptations as fall within the scope of the appended claims.

I claim:

1. An apparatus for guiding a textile tube to a machine having a set of rollers defining a fabric intake passage, the apparatus comprising:

a support, a feeding arm having a first end mounted to the support and a second end, and a spreader mounted to the feeding arm for spreading the textile tube in a direction of the intake passage, wherein when the feeding arm is oriented in a feeding position extending substantially perpendicular to the intake passage and the textile tube is fed into the intake passage, the rollers draw the textile tube off of the feeding arm with substantially no longitudinal tension on the textile tube.

2. The apparatus of claim 1 in which the feeding arm is rotatably mounted to the support and can be rotationally fixed in the feeding position.

3. The apparatus of claim 2 in which the feeding arm is supported at an angle of declination such that the second end is supported at a height lower than a height of the first end.

4. The apparatus of claim 3 in which the angle of declination of the feeding arm is adjustable.

5. The apparatus of claim 4 in which an adjusting bolt axially fixed relative to the support bears against the feeding arm, whereby rotation of the adjusting bolt adjusts the angle of declination of the feeding arm.

6. The apparatus of claim 2 in which a plurality of feeding arms are rotatably mounted to the support, such that each feeding arm can be rotated into the feeding position.

7. The apparatus of claim 2 in which the spreader is removable.

8. The apparatus of claim 2 in which the spreader laterally tensions the textile tube.

9. The apparatus of claim 8 in which the spreader comprises shoulders which diverge in a direction of removal of the textile tube.

10. An apparatus for rolling a textile tube, comprising a set of rollers defining a fabric intake passage, a support spaced from the fabric intake passage, a feeding arm having a first end mounted to the support and a second end, and a spreader mounted to the feeding arm for spreading the textile tube in a direction of the intake passage, wherein when the feeding arm is oriented in a feeding position extending substantially perpendicular to the intake passage and the textile tube is fed into the intake passage, the rollers draw the textile tube off of the feeding arm with substantially no longitudinal tension on the textile tube.

11. The apparatus of claim 10 in which the feeding arm is rotatably mounted to the support and can be rotationally fixed in the feeding position.

12. The apparatus of claim 11 in which the feeding arm is supported at an angle of declination such that the second end is supported at a height lower than a height of the first end.

13. The apparatus of claim 12 in which the angle of declination of the feeding arm is adjustable.

14. The apparatus of claim 13 in which an adjusting bolt axially fixed relative to the support bears against the feeding arm, whereby rotation of the adjusting bolt adjusts the angle of declination of the feeding arm.

15. The apparatus of claim 11 in which a plurality of feeding arms are rotatably mounted to the support, such that each feeding arm can be rotated into the feeding position.

16. The apparatus of claim 11 in which the spreader is removable.

17. The apparatus of claim 11 in which the spreader laterally tensions the textile tube.

18. The apparatus of claim 17 in which the spreader comprises shoulders which diverge in a direction of removal of the textile tube.

19. A method of feeding a textile tube into a set of rollers defining a fabric intake passage, comprising the steps of:

a. loading a textile tube onto a feeding arm, b. positioning the feeding arm in alignment with the intake passage and substantially perpendicular to the intake passage drawing the textile tube off of the feeding arm, c. drawing a free end of the textile tube to the intake passage such that the rollers draw the textile tube off of the feeding arm, and d. spreading the textile tube to flatten same as the textile tube is drawn off of the feeding arm by the rollers.

20. The method of claim 19 wherein in the step of spreading the textile tube a lateral tension is applied to the textile tube.

* * * * *